United States Patent [19]

Maslo et al.

[11] 4,420,122

[45] Dec. 13, 1983

[54] LIGHTING DEVICE SUSPENDING SYSTEM

[76] Inventors: Karl E. Maslo, Haufstrasse 7, D-8000 Muenchen 7, Fed. Rep. of Germany; Suzuki Hiroyuki, 508, Yono-shi, Saitama, Japan

[21] Appl. No.: 317,233

[22] Filed: Nov. 2, 1981

[51] Int. Cl.[3] ..... B66D 3/24; B66D 3/20; B65H 75/00

[52] U.S. Cl. ..... 242/54 R; 254/270; 254/272

[58] Field of Search ..... 242/54 R, 54 A; 254/270, 272; 191/12 R, 12.2 A, 12.2 R, 12.4

[56] References Cited

U.S. PATENT DOCUMENTS

| | | | |
|---|---|---|---|
| 3,148,261 | 9/1964 | Schlenz | 242/54 R |
| 3,182,961 | 5/1965 | Le Bus, Sr. | 254/272 X |
| 3,807,648 | 4/1974 | Worwag | 242/54 R |

*Primary Examiner*—Stuart S. Levy
*Assistant Examiner*—Scott J. Haugland
*Attorney, Agent, or Firm*—C. O. Marshall, Jr.; C. O. Marshall, Jr.

[57] ABSTRACT

A telescopically extendable hanging mechanism for suspending a lighting device has a driving mechanism provided with wires for controlling extension of the hanging mechanism. A wire take-up means for winding up or unwinding the wires is adapted for telescopically extending out or contracting the hanging mechanism. The wire take-up means is given a rotative force and consists of three discs of which the outermost disc has a recess at its outer edge. A ratchet wheel is provided in the wire take-up means and a sensor lever is provided swingably above the wire take-up means and is always pressed in the direction of the take-up means. The sensor lever is provided with pawls so arranged that they are engaged with the ratchet wheel when the sensor lever is swung toward the take-up means. A pulley is rotatably mounted at an end of the sensor lever and is adapted to receive the wires used for telescopically extending out or contracting the hanging mechanism. A limit switch is designed to detect any swinging motion of the sensor lever in the direction away from the take-up means to cut off the rotative force. A slider provided slidably on a diametrical portion of the outermost disc of said take-up means has its one end projected into the take-up means while the other end terminates in a sector portion positioned in the recess of the take-up means.

1 Claim, 17 Drawing Figures

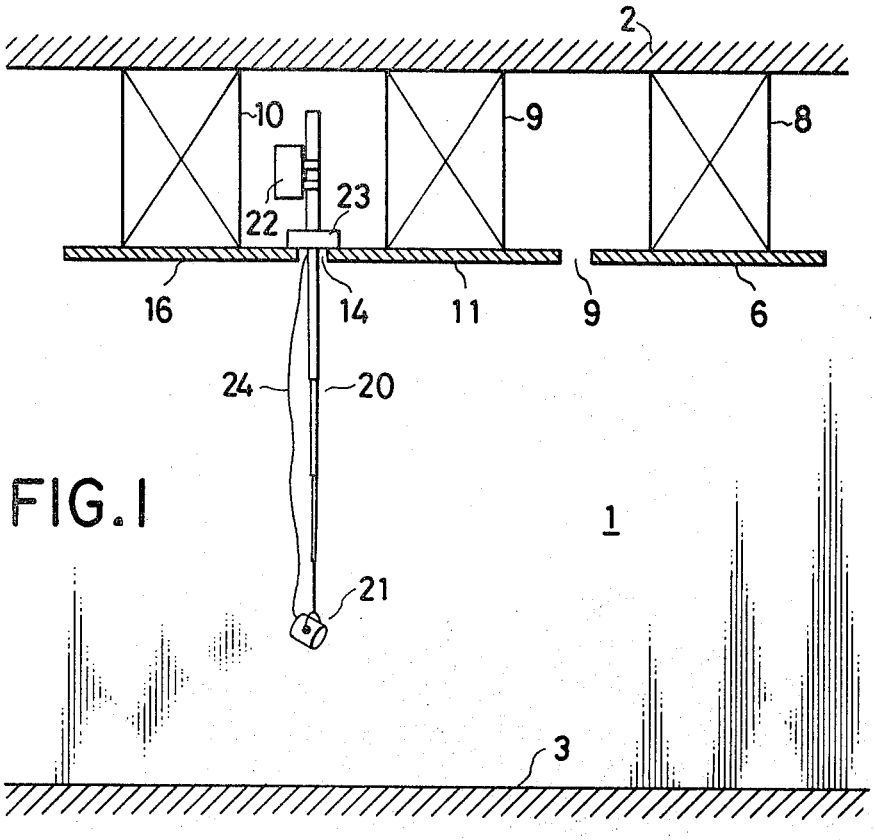
FIG. 1
FIG. 2
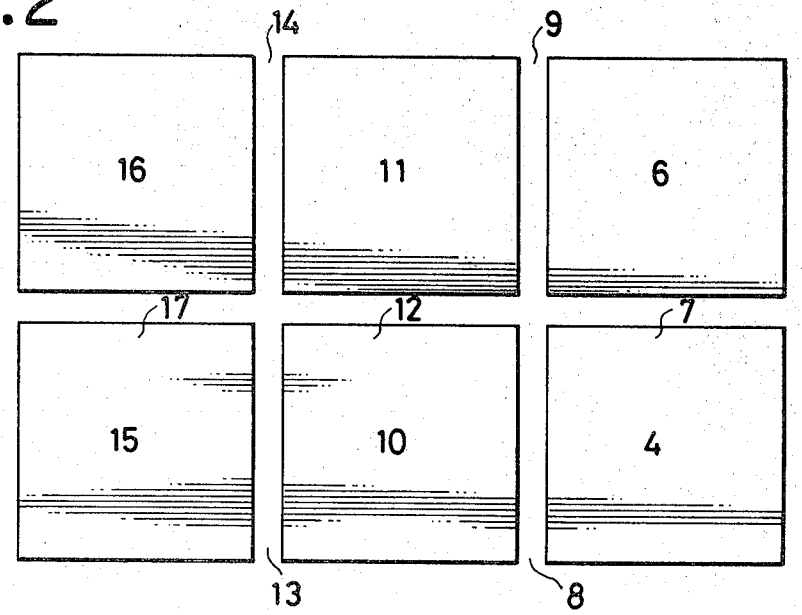

539
201
243
244
246
102
242
238
245
230
233
216
231
(232)
221
235
234
214
212
213
214
216
201a
214
220
215
214
214
214
211
210
224
223
217
257
256
250
251
(252)
253
255
254
260
262
261
263

LIGHTING DEVICE SUSPENDING SYSTEM

BACKGROUND OF THE INVENTION

1. Field of the Invention

This invention relates to a suspending system for an illumination light of the type used in a studio in a TV station or other facilities.

2. Description of the Prior Art

A typical conventional lighting device suspending system is here described with reference to FIGS. 1 and 2 of the accompanying drawings. In the figures, numeral 1 designates the interior of a studio, 2 the ceiling wall of the studio, and 3 the floor of the studio. The lighting device supporting floor segments 4, 6, 10, 11, 15, 16 are hung down from the ceiling wall of the studio by hanging means 8, 9, 10, said floor segments being arranged regularly while spaced-apart from each other to form the spaces or lanes 7, 8, 9, 12, 13, 14, 17. A travelling mechanism 23 for moving the lighting device is disposed bridging two opposing floor segments, 11 and 16 in FIG. 1, and a telescopic hanging mechanism 20 extends down from said travelling mechanism 23. At the lower end of said hanging mechanism 20 is provided an illumination light 21 to which is connected an electric wire 24 extending from above the floor segments 11, 16.

According to such conventional lighting device suspending system, in case the illumination light 21 being lowered down becomes unable to descend as it contacts an object in the studio or for other causes, if the operator continues to unwind the flat wires adapted to support the hanging mechanism, such wires might be stuffed up in the driving mechanism to cause troubles.

Also, in case the illumination light 21 being raised up is hindered from ascending due to accidental engagement with an object in the studio or for other causes, if the flat wires are kept wound up, said wires might be cut or otherwise damaged.

Further, there was a risk of cutting of the wires if they are further wound up when the hanging mechanism has reached its shortmost position. Conversely, if the wires are kept unwound when the hanging mechanism has reached its maximally extended out position, said wires might be wound up in the opposite direction.

SUMMARY OF THE INVENTION

The present invention is to provide a lighting device suspension system designed to eliminate the defects and disadvantages inherent to the conventional suspending systems such as mentioned above. In order to attain this object, the present invention provides an improved driving mechanism whereby the hanging mechanism of the lighting device suspension system is telescopically extended out or contracted by wire means, said driving mechanism comprising a wire take-up means for taking up the wires adapted for telescopically extending out or contracting the hanging mechanism, said take-up means being given a rotative force and consisting of discs of which the outermost disc has a recess at its outer edge; a ratchet wheel secured inside said take-up means; a sensor lever provided swingably above said take-up means and always pressed toward said take-up means, said sensor lever being provided with pawls arranged to engage with the ratchet wheel when said sensor lever is swung toward the take-up means; a pulley disposed rotatably at an end of said sensor lever and adapted to receive the wires for driving the hanging mechanism; a limit switch designed to detect any swinging motion of said sensor lever in the direction opposite from the take-up means to cut off the rotative force; a slider disposed swingably at the outermost portion of said take-up means and having its one end projecting into said take-up means while the other end thereof terminates into a sectorial portion in fitted relation with the recess in said take-up means; and an unwinding sensor lever disposed swingably below said take-up means and always urged toward said take-up means, said lever having provided on its underside a roll in contact with the outer edge of said take-up means and provided with a pawl arranged to engage with the ratchet wheel when said roll fits into the recess at the outer edge of said take-up means.

BRIEF DESCRIPTION OF THE DRAWINGS

FIG. 1 is a longitudinal sectional view of a studio where a lighting device suspension system is set.

FIG. 2 is a plan view of the supporting floor for the suspension system.

DESCRIPTION OF THE PREFERRED EMBODIMENTS

Figure 3:
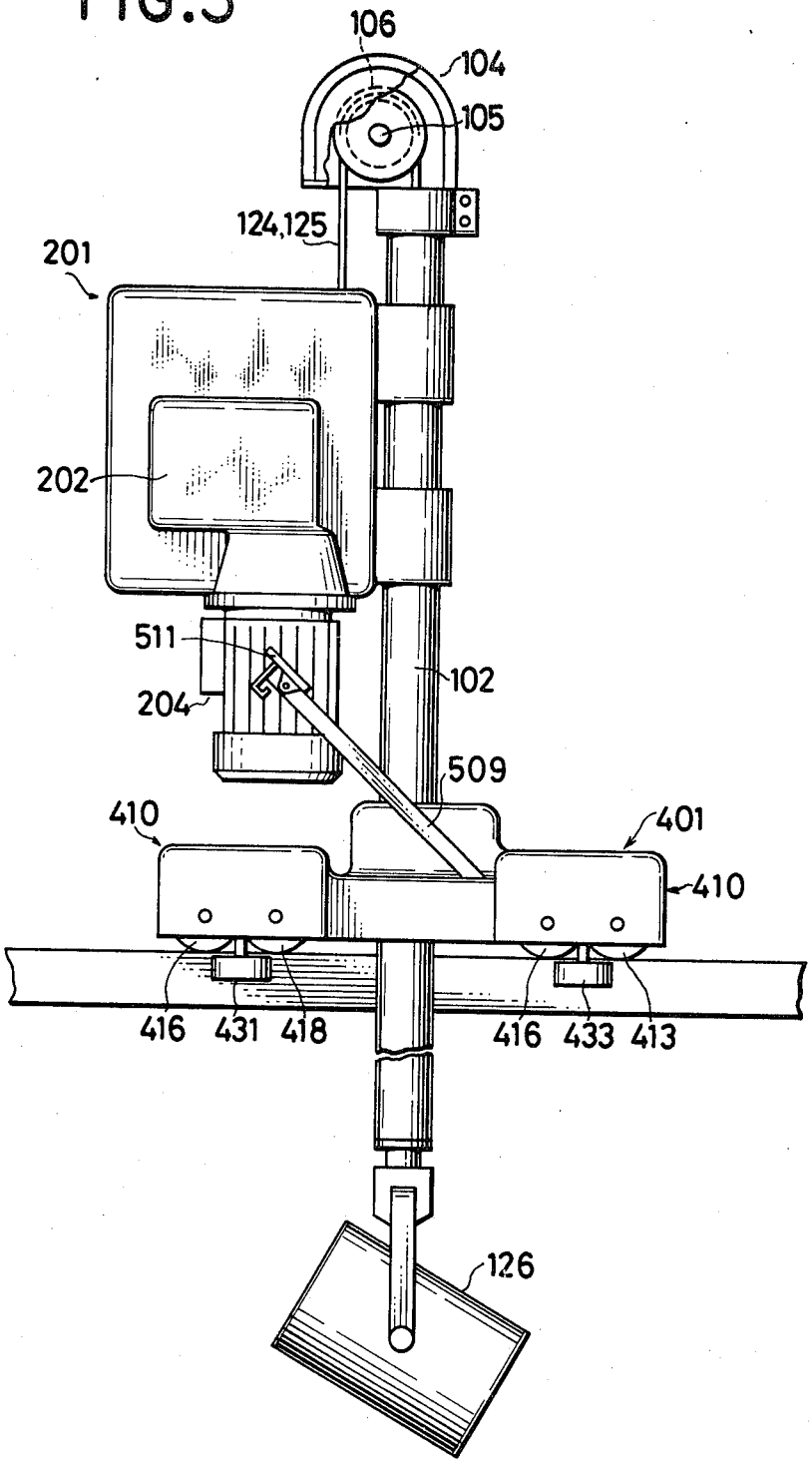
FIG. 3 is a general side view of the lighting device suspension system.
Figure 4:
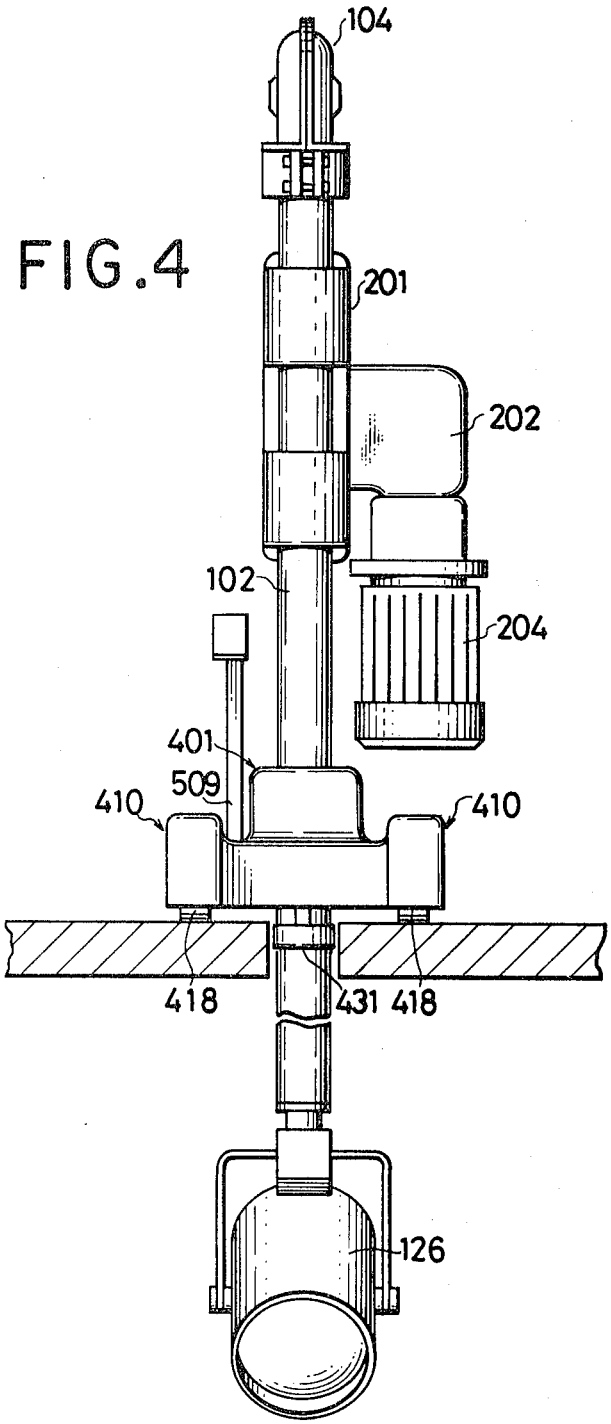
FIG. 4 is a general frontal view of the lighting device suspension system.
Figure 5:
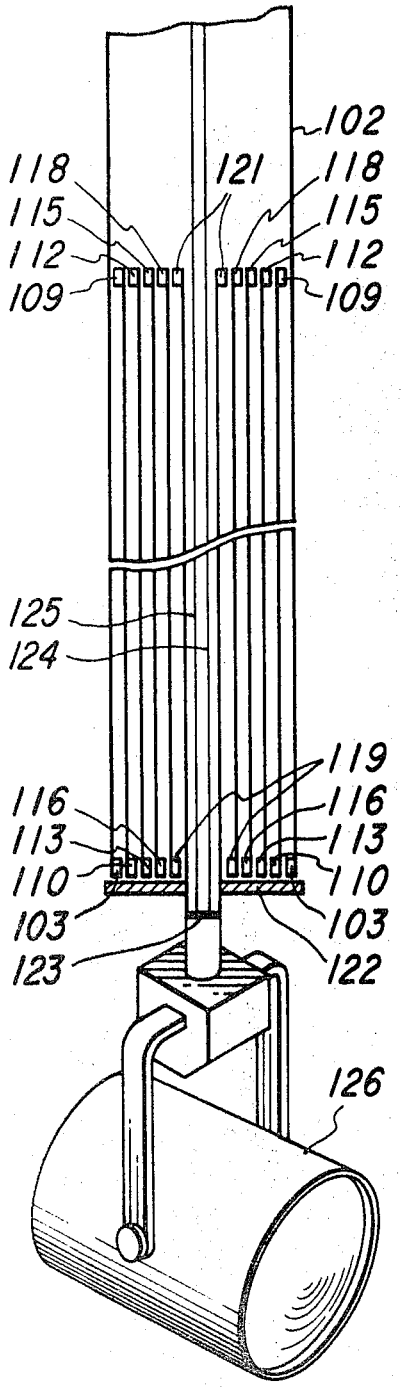
FIG. 5 is a partial longitudinal sectional view of the hanging mechanism.
Figure 6:
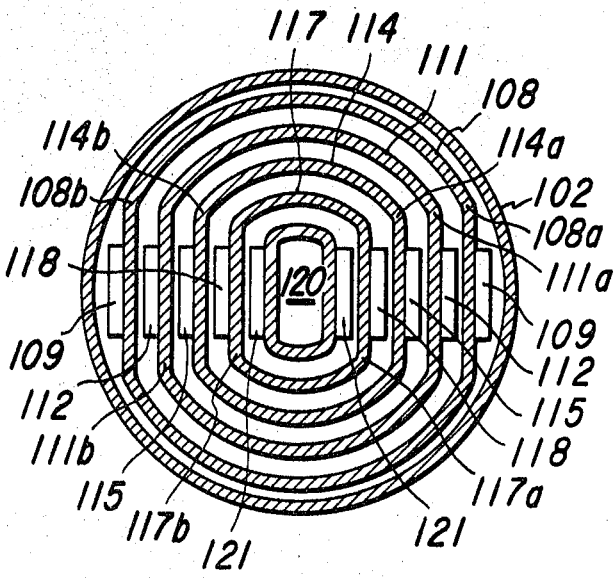
FIG. 6 is a cross-sectional view of the hanging mechanism.

The description starts with the hanging mechanism for an illumination light with reference to FIGS. 3 to 6. A first cylindrical hanging pipe 102 is securely supported at its middle part by a truck 401 in a vertical relation thereto. At the inner periphery of the lower end of said first hanging pipe 102 are provided the stoppers 103, 103 in opposed relation to each other, and a pulley cover 104 is secured to the top end of said hanging pipe 102. A fixed shaft 105 is passed substantially centrally of said pulley cover 104, and a pulley 106 having two rows of grooves is rotatably mounted on said shaft 105. Inside said first hanging pipe 102 is slidably disposed a second hanging pipe 108 having the opposing and parallel flat portions 108*a*, 108*b* at the parts on both sides thereof in the axial direction. At the outer periphery of the top end of said second hanging pipe 108 are provided the stoppers 109, 109 in positional coincidence with said flat portions 108*a*, 108*b*. Also, at the inner periphery of the lower end of said second hanging pipe 108 are provided the stoppers 110, 110 positionally corresponding to the flat portions 108*a*, 108*b*. In the inside of said second hanging pipe 108 is slidably disposed a third hanging pipe 111 having the opposing and parallel flat portions 111*a*, 111*b* at both side parts thereof in the axial direction, and stoppers 112, 112 are provided at the outer periphery of the upper end of said third hanging pipe 111 in positional coincidence with said flat portions 111*a*, 111*b*. Similar stoppers 113, 113 are also provided at the inner periphery of the lower end of said third hanging pipe 111 in positional correspondence of the flat portions 111*a*, 111*b*. A fourth hanging pipe 114 is slidably disposed in said third hanging pipe 111, said fourth hanging pipe 114 having the opposing and parallel flat portions 114*a*, 114*b* at both side parts in the axial direction thereof. Said fourth hanging pipe 114 is also provided with stoppers 115, 115 at the outer periphery of its upper end in positional coincidence with said flat portions 114*a*, 114*b*, and stoppers 116, 116 at the inner periphery of the lower end in positional correspondence to said flat portions 114*a*, 114*b*. In said fourth hanging pipe 114 is slidably disposed a fifth hanging pipe 117 having the opposing and parallel flat portions 117*a*, 117*b*, stoppers 118, 118, and stoppers 119, 119, all being same in positional arrangement as those in the aforesaid pipes. Slidably disposed in this fifth hanging pipe 117 is a substantially prismatic sixth hanging pipe 120. At the outer periphery of the top end of said sixth hanging pipe 120 are provided the stoppers 121, and at the lower end of said sixth hanging pipe 120 is provided a flange 122 of the same diameter as the first hanging pipe 102. The first to fifth hanging pipes 102–117 are all supported at their bottoms on said flange 122. Also, a pin 123 is passed inside the lower end of said sixth hanging pipe 120, and the flat wires 124, 125 arranged spaced-apart from each other are connected to said pin 123. The upper portions of said flat wires 124, 125 are wound round a pulley 106 mounted atop the first hanging pipe 102, said wires being wound up or unwound to extend down by a driving mechanism provided at the middle part of the first hanging pipe 102. It will be also seen that an illumination light 126 is provided at the lower end of the sixth hanging pipe 120.

The operation of this hanging mechanism is now described. When the flat wires 124, 125 are in the wound-up state, the hanging mechanism takes its shortest form, with all the inside pipes being housed in the first hanging pipe 102, so that the illumination light 126 stays at an elevated position. Then, when the flat wires 124, 125 begin to be unwounded to extend down, the sixth hanging pipe 120 begins to descend correspondingly, causing the second to fifth hanging pipes to descend all together as the bottom portions of these pipes rest on the flange 122 of the sixth hanging pipe 120. The descent of the second hanging pipe 108 is stopped when the stoppers 109, 109 at the outer periphery of the upper end of said second hanging pipe 108 are engaged with the corresponding stoppers 103, 103 at the inner periphery of the lower end of the first hanging pipe 102. As the flat wires 124, 125 are further unwound, the stoppers 112, 112 at the outer periphery of the upper end of the third hanging pipe 111 come to engage with the corresponding stoppers 110, 110 at the inner periphery of the lower end of the second hanging pipe 108 to stop the descent of the third hanging pipe 111. In the similar way, the stoppers 115, 115 at the outer periphery of the upper end of the fourth hanging pipe 114 are engaged with the stoppers 113, 113 at the inner periphery of the lower end of the third hanging pipe 111, then the stoppers at the outer periphery of the upper end of the fifth hanging pipe are engaged with the stoppers 116, 116 at the inner periphery of the lower end of said fourth hanging pipe 114, and then the stoppers 121, 121 at the outer periphery of the upper end of this sixth hanging pipe 120 are engaged with the stoppers 119, 119 at the inner periphery of the lower end of said fifth hanging pipe 117, thereby finally producing the longest (that is, maximally extended-out) condition of the hanging mechanism.

On the other hand, when the flat wires 124, 125 begin to be wound up, first the bottom of the fifth hanging pipe 117 is placed on the flange 122 of the sixth hanging pipe 120, allowing said fifth hanging pipe 117 to rise up with the sixth hanging pipe 120, and then the bottom of the fourth hanging pipe 114 is placed on said flange 122 of the sixth hanging pipe 120 to let said fourth hanging pipe 114 rise up with the sixth hanging pipe 120. The similar operation takes place until the bottom of the second hanging pipe 108 is located on the flange 122 of the sixth hanging pipe 120 to rise up with said sixth hanging pipe 120, and when finally the flange 122 of the sixth hanging pipe 120 comes to abut against the lower end of the first hanging pipe 102, the hanging mechanism takes its shortest form.

This hanging mechanism is also arranged such that the stoppers 103, 103 provided on the first hanging pipe 102 are engaged with the flat portions 108*a*, 108*b* of the second hanging pipe 108 to prevent said second hanging pipe 108 from rotating, and the stoppers 110, 110 at the inner periphery of the lower end of the second hanging pipe 108 are engaged with the flat portions 111*a*, 111*b* of the third hanging pipe 111, and likewise the stoppers 112, 112 at the outer periphery of the upper end of the third hanging pipe 111 are engaged inwardly with the flat portions 108*a*, 108*b* of the second hanging pipe 108 to prevent rotation of the third hanging pipe 111. Also, the stoppers 113, 113 at the inner periphery of the lower end of the third hanging pipe 111 are engaged with the corresponding flat portions 114*a*, 114*b* of the fourth hanging pipe 114, and the stoppers 115, 115 at the outer periphery of the upper end of the fourth hanging pipe 114 are engaged with the insides of the flat portions 111*a*, 111*b* of the third hanging pipe 111 to lock the fourth hanging pipe 114 against rotation. Further, the stoppers 116, 116 at the inner periphery of the lower end of the fourth hanging pipe 114 are engaged with the flat portions 117*a*, 117*b* of the fifth hanging pipe 117 and the stoppers 118, 118 at the outer periphery of the upper end of the fifth hanging pipe 117 are engaged with the flat portions 114*a*, 114*b* of the fourth hanging pipe 114 to check the rotation of the fifth hanging pipe 117. Likewise, the stoppers 119, 119 at the inner periphery of the lower end of the fifth hanging pipe 117 are engaged with the side portions of the sixth hanging pipe 120 and the stoppers 121, 121 at the outer periphery of the upper end of the sixth hanging pipe 120 are engaged with the flat portions 117*a*, 117*b* of the fifth hanging pipe 117 to prevent rotation of the sixth hanging pipe 120. Thus, the hanging mechanism, although able to telescopically extend out and contract in the vertical direction, is inhibited from turning about its axis, so that the illumination light 126 secured to the lower end of the sixth hanging pipe 120 won't be changed in its direction unless it is operated for that purpose.

Figure 7:
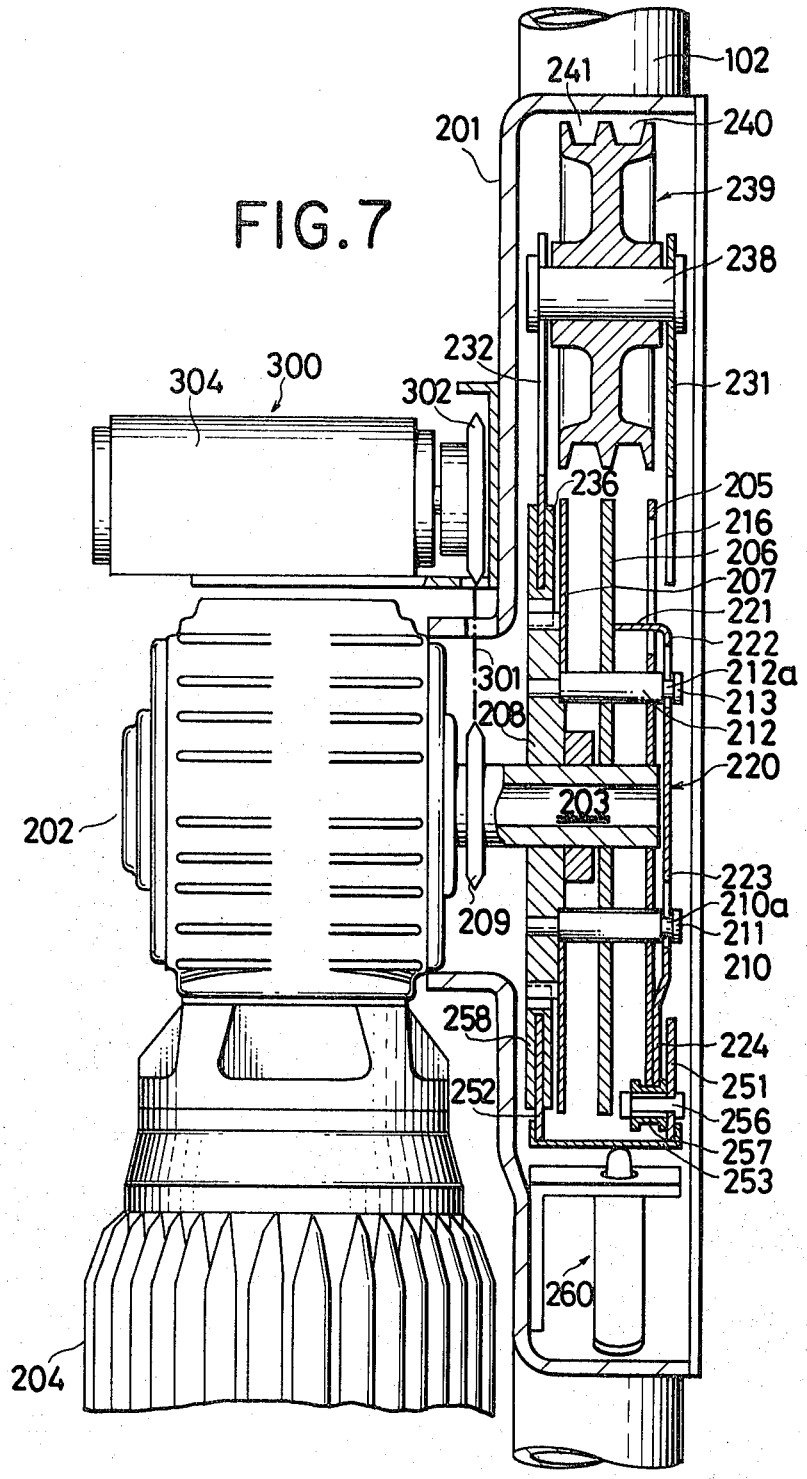
FIG. 7 is a frontal longitudinal sectional view of the driving mechanism.
Figure 8:
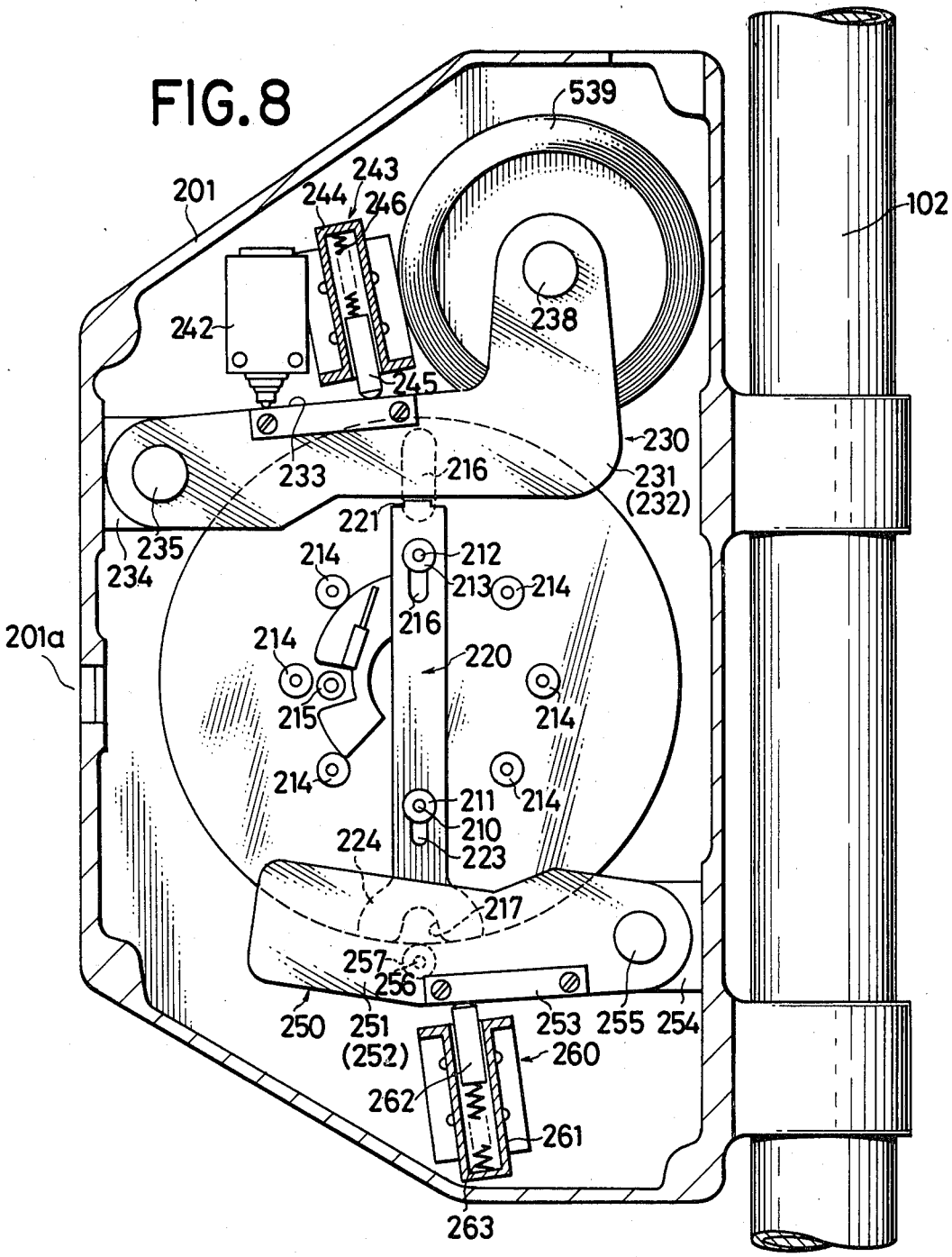
FIGS. 8 and 9 are side-elevational longitudinal sectional views of the driving mechanism.
Figure 9:
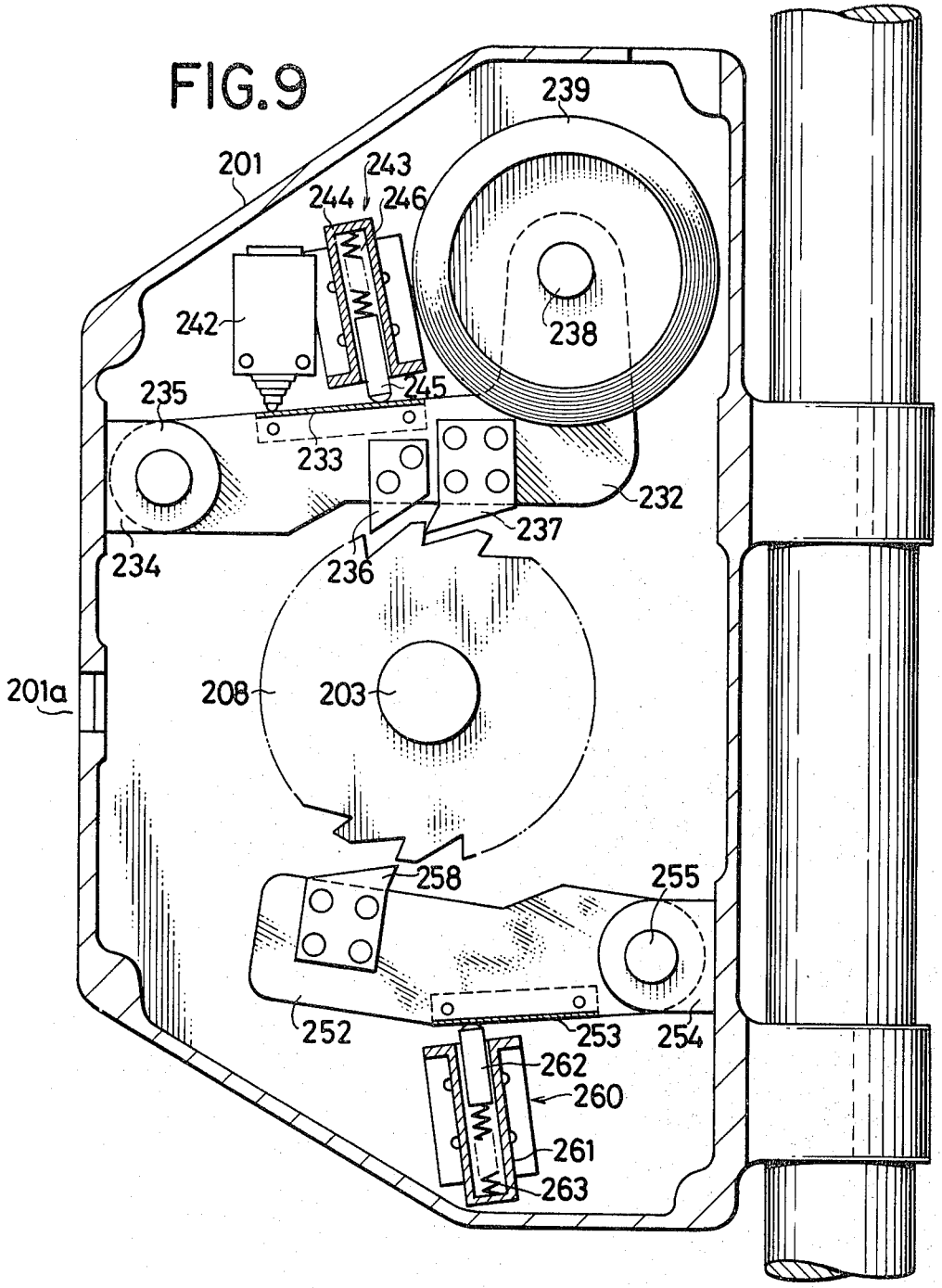

Now, the driving mechanism adapted for driving the hanging mechanism is described with particular reference to FIGS. 7 to 9. A housing case 201 of the driving mechanism is secured to an upper part of the first hanging pipe 102. Said case 201 has a window opening 201*a* for allowing eye observation of the inside condition in the case. A reduction gear assembly 202 of a known structure is secured to a side of the case 201. The output shaft 203 of said reduction gear projects into the inside of the case 201 while the input shaft (not shown) thereof is disposed at a lower part of the reduction gear assembly 202. Said input shaft is connected through a friction clutch (not shown) to the output shaft of a motor 204 mounted below the reduction gear assembly 202. Secured to the output shaft 203 of the reduction gear assembly 202 are the discs 205, 206, 207 arranged spaced-apart from each other to constitute a flat wire take-up means. At the central parts of said discs 205, 206, 207 are circumferentially and equi-distantly arranged 11 take-up pins 214, 210, 212 designed to circularly wind up the flat wires 124, 125. Among these 11 take-up pins 214, 210, 212, two of them 210 and 212 arranged in opposed relation have the protuberances 210*a*, 212*b* which project from the external surface of the disc 205. Also disposed inwardly of said take-up pins 214, 210, 212 are the connection pins 215 to which the ends of the flat wires 124, 125 are connected. Disposed on the inside of the innermost disc 207 of the take-up means is a ratchet wheel 208 secured to the output shaft 203 of the reduction gear 202, and a sprocket 209 secured to the output shaft 203 of the reduction gear 202 is disposed on the inside of said ratchet wheel 208. Also, the outermost disc 205 of the take-up means is formed with an elongated slot 216 in the diametrical direction at a position outward of the take-up pin 212. Said disc 205 is also formed with a recess 217 at an outer edge at a position opposing to the elongated slot 216. Rolls 211, 213 are rotatably secured to the protuberances 210*a*, 212*a* of the take-up pins 210, 212 projecting from the disc 205, said rolls 211, 213 being fitted in the elongated slots 222, 223, respectively, formed in a slider 220 in its axial direction. At an end of said slider 220 is formed a pressure piece 221 which is bent perpendicularly and placed in the slot 216 in the disc 205, and the other end of said slider 220 terminates into a substantially fan-shaped sector portion 224. Disposed above said take-up means is a sensor lever assembly 230 swingably pivotted by a pin 235 secured to a fixture 234 projecting from the rear side of the upper wall of the case 201, said sensor level assembly 230 comprising two substantially L-shaped lever plates 231, 232 arranged spaced-apart from each other in an opposed relation. The corresponding ends of said lever plates 231, 232 are secured to a fixed shaft 238 to which a pulley 239 is rotatably mounted. Said pulley 239 is provided with two rows of grooves 240, 241 arranged spaced-apart from each other for receiving the flat wires 124, 125 from the pulley 106 of the hanging mechanism, said flat wires 124, 125 being connected to the connection pins 215 in the take-up means. A connecting plate 233 is provided vertically on the upper side of the middle parts of said lever plates 231, 232, and pawls 236, 237 are provided on the lower side of the middle part of the lower lever plate 232, said pawls 236, 237 being spaced-apart from each other and arranged to engage with the ratchet wheel 208 as the sensor lever assembly 230 is swung. A limit switch 242 is provided for sensing the swinging motion of the sensor lever assembly 230 at the position of said connecting plate 233. There is also provided a pressing mechanism 243 adapted for constantly pressing said sensor lever assembly 230 toward the ratchet wheel 208, said pressing mechanism 243 comprising a cylindrical body 244 having disposed therein a compression spring 246 and a slidable pressing rod 245 pressed by said compression spring 246, said pressing rod 245 pressing at its end against the connecting plate portion of the sensor lever assembly 230. Also, an unwinding sensor lever assembly 250 is provided below the take-up means, said unwinding sensor lever assembly 250 comprising two opposing spaced-apart lever plates 251, 252 and a vertical connecting plate 253 extending across the middle parts on the lower side of said respective lever plates 251, 252. A protuberance 254 is provided on the inside of the case 201 for swingably supporting said sensor lever assembly 250 to the case 201. The right end of said unwinding sensor lever assembly 250 is swingably joined to said protuberance 254 by a pin 255. Also, a pin 256 is planted on the underside of a middle part of the lever plate 251, said pin 256 having rotatably mounted thereon a roll 257 arranged in contact with an outer edge of the outermost disc 205 of the take-up means. There is also provided in positional coincidence with said connecting plate 253 a pressing mechanism 260 adapted for pressing the unwinding sensor lever assembly 250 toward the take-up means, said pressing mechanism 260 comprising a cylindrical body 261 housing therein a compression spring 263 and a slidable pressing rod 262 pressed by said compression spring 263 so that the end of said rod 262 presses on the connecting plate 253 of the sensor lever assembly 250. Also, a pawl 258 is provided on the upper side of a left portion of the lower lever plate 252 of said unwinding sensor lever assembly 250, said pawl 258 being arranged to engage with the ratchet wheel 208 when said sensor lever assembly 250 is turned clockwise.

The operation of the driving mechanism is now described. Since the flat wires 124, 125 are always under the load of the hanging mechanism, a tension is produced in said flat wires, urging the sensor lever 230 to swing in the counterclockwise direction till it is stopped at the position where the tensile force is balanced with the pressing force of the pressing mechanism 243. With the sensor lever 230 being at this standstill position, the pawls 236, 237 of the lower lever plate 232 are separate from the ratchet wheel 208, allowing the take-up reel to turn independently of said sensor lever 230. In the course of winding of the flat wires 124, 125 on the take-up reel under this condition, should the hanging mechanism contact an object in the studio to hinder the flat wires from being wound up, the sensor lever 230 is turned counterclockwise, and such counterclockwise turn of the sensor lever 230 is detected by the limit switch 242 to stop the motor 204, thereby preventing cutting of the flat wires 124, 125. In case the flat wires 124, 125 are unwound from the take-up reel, if the flat wires are kept extending out even when the lower part of the hanging mechanism has hit an object in the studio to hinder the descent of the hanging mechanism, said wires 124, 125 might be stuffed up in the case 201 of the driving mechanism to cause trouble, so that the unwinding operation of the driving mechanism must be stopped. According to this invention, since no tension of the flat wires 124, 125 is given to the sensor lever 230 when the hanging mechanism becomes unable to descend, the sensor lever 230 is turned clockwise till its pawls 236, 237 are engaged with the ratchet wheel 208 to stop rotation of the take-up reel. When the rotation of the take-up reel is stopped, the input shaft of the reduction gear 202 also stops rotating, but there is no fear that the motor 204 be overloaded as a friction clutch (not shown) is provided between said input shaft and the motor.

Here, the mechanism for preventing reverse winding of the flat wires 124, 125 connected to the connecting pins 215 in the take-up reel is described. In case the wound-up portions of the flat wires 124, 125 exist in the take-up reel, the bent pressing piece 221 at an end of the slider 220 provided slidably on the external surface of the outermost disc 205 of the take-up reel is pressed by the flat wires 124, 125 to force slider downwardly so that the sector portion 224 at the other (lower) end of the slider 220 coincides with the outer edge of the disc 205, and under this condition the roll 257 on the sensor lever 250 which is rotated while pressed against the outer edge of the disc 205 is only allowed to rotate on the outer edge of said disc 205. However, when the flat wires 124, 125 on the take-up reel are all extended out, the pressing piece 221 of the slider 220 is not longer pressed by the flat wires 124, 125 so that the roll 257 of the sensor lever 250 rotating while pressed on the outer edge of the disc 205 now presses against the sector portion 224 of the slider 220 and forces into the recess 217 of the disc 205, whereupon the sensor lever 250 is forced to turn clockwise till its pawl 258 is engaged with the ratchet wheel 208 to stop unwinding operation of the take-up reel. Therefore, under the condition where there exits no remaining portion of the flat wires 124, 125 in the take-up reel, further winding is performed to prevent the flat wires 124, 125 from being wound up in the reverse direction on the take-up reel.

Figure 10:
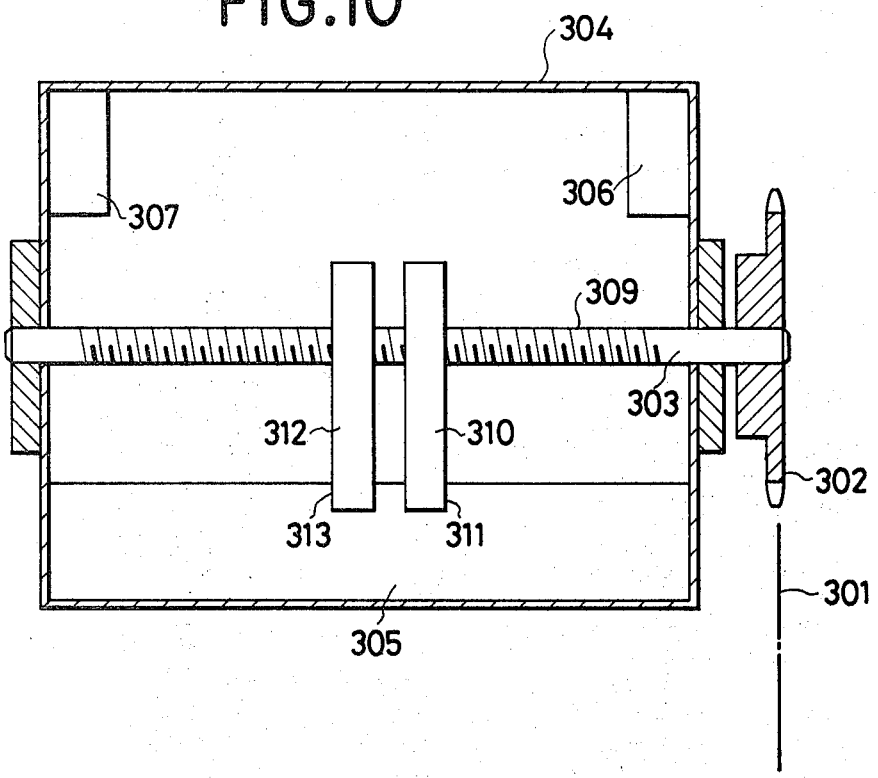
FIG. 10 is a longitudinal sectional view of the stopping mechanism.

The stopping mechanism 300 for the driving mechanism is now described with reference to FIGS. 7 and 10. This stopping mechanism 300 is designed to regulate the limits of ascent and descent of the hanging mechanism in accordance with the condition in the studio. A roller chain 301 is wound round a sprocket 209 secured to the output shaft 203 of the reduction gear 202 in the driving mechanism, said roller chain 301 being led outside the case 201 of the driving mechanism and connected to a sprocket 302 of the stopping mechanism 300, which sprocket 302 is disposed on the external wall face of the case 201. A shaft 303 to which the sprocket 302 is secured is rotatably passed through the case 304 of said stopping mechanism 300, said shaft 303 being provided with an external thread 309 with which the mating internal threads of the sliders 310, 312 are engaged. Said sliders 310, 312 have at their ends the recessed grooves 311, 313 in which is fitted a fixed plate 305 detachably provided to the case 304, thus allowing the sliders 310, 312 to slide sidewise when the shaft 303 rotates. Also, limit switches 306, 307 are provided in the case 304 at its both sides, said limit switches 306, 307 being designed to be actuated by the sliding motion of the sliders 310, 312.

The operation of this stopping mechanism 300 is as follows. While the hanging mechanism is ascending, the rotation of the output shaft 203 of the reduction gear 202 is transmitted through the sprocket 209, chain 301 and another sprocket 302 to the shaft 303 to let it rotate, causing corresponding leftward movement of the sliders 312, 310, and when the slider 312 presses the limit switch 307, the motor 204 of the driving mechanism is stopped rotating to stop further ascent of the hanging mechanism. On the other hand, when the hanging mechanism is descending, the output shaft 203 of the reduction gear 202 rotates reversely, causing the sliders 310, 312 to move rightwards, and when the slider 310 presses the limit switch 306, the motor 204 of the driving mechanism is stopped rotating to stop further descent of the hanging mechanism. The position at which the ascent of the hanging mechanism is stopped can be regulated by adjusting the position of the slider 312 by removing the fixing plate 305, while the descent stopped position of the hanging mechanism can be regulated by adjusting the position of the slider 310 in the similar way. Thus, the upper and lower limits of movement of the hanging mechanism can be freely adjusted in conformity to the condition in the studio.

Figure 11:
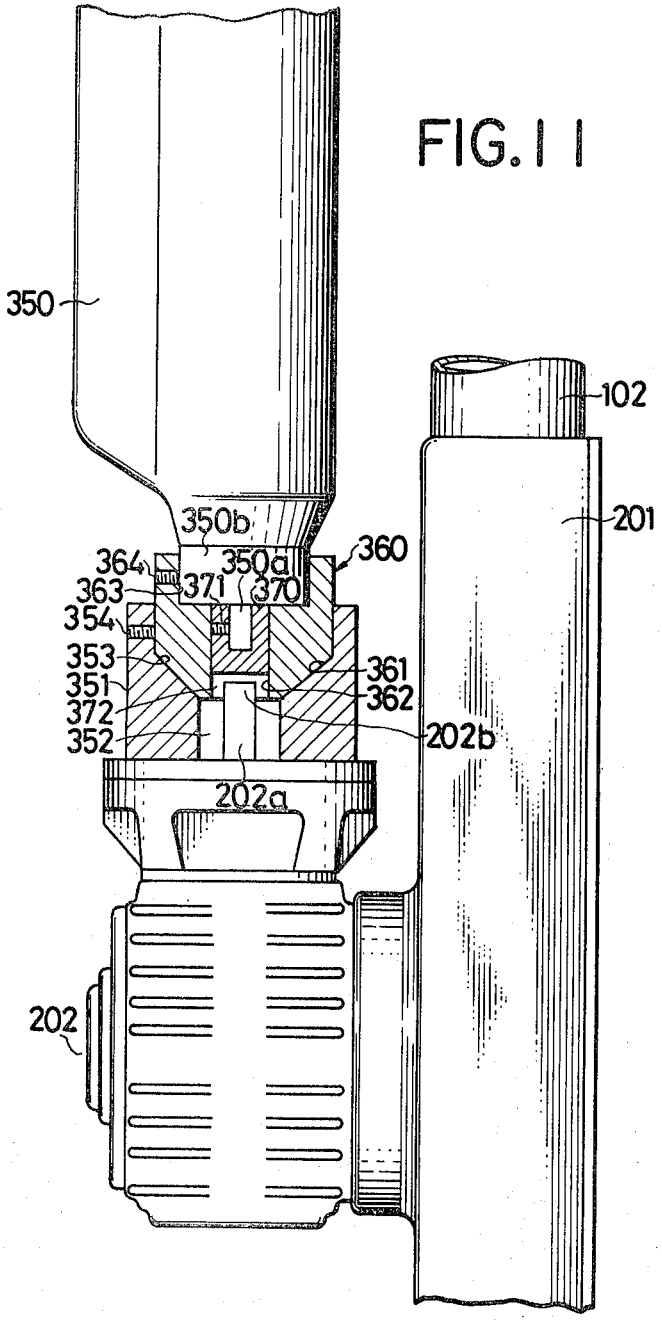
FIG. 11 is a partial frontal longitudinal sectional view showing another embodiment of the motor assembly in the the driving mechanism.

Now, another embodiment of the motor and reduction gear assembly in the driving mechanism according to this invention is described with reference to FIG. 11. In this embodiment, the rotative force of a power drill 350 is utilized instead of the motor. The input shaft **202*a* of the reduction gear 202 is positioned upwardly, and a mount 351 is provided around the input shaft 202*a* of the reduction gear 202, said mount 351 having at its center a hole 352 housing the input shaft 202*a* of the reduction gear 202. Also, a tapered fitting portion 353 is disposed contiguous to said hole 352. Also, a coupler 360 is provided at said fitting portion 353 of the mount 351, said coupler 360 having at its end a tapered portion 361 congruent to said fitting portion 353 of the mount 351. Said coupler 360 also has at its center a hole 362 in which the output shaft 350*a* of said power drill 350 is disposed. Above said central hole 362 is provided a recess 363 in which the end portion 350*b* of the power drill 350 is fitted. Said coupler 360 is secured tightly to the mount 351 by a set screw 354 passed through said mount 351. Also, the end portion of the power drill 350 is secured pressedly to the coupler 360 by a set screw 364 passed through said coupler 360. Further, a connecting piece 370 is secured to the output shaft 350*a* of the power drill 350 by a set screw 371 passed through said connecting piece 370, said connecting piece 370 being arranged rotatable in the central hole 362 of the coupler 360 and having at its end a recess 372 in which is fitted the connecting portion 202*b* at the end of the input shaft 202*a* of the reduction gear 202 such that the top face of said connecting portion 202*b* is parallel to the opposing face of said connecting piece 370, whereby the rotative force of the power drill 350 is transmitted to the input shaft 202*a* of the reduction gear 202**.

This embodiment using a power drill 350 as the power source of the driving mechanism is employed where a simple and uncostly system is required.

Figure 12:
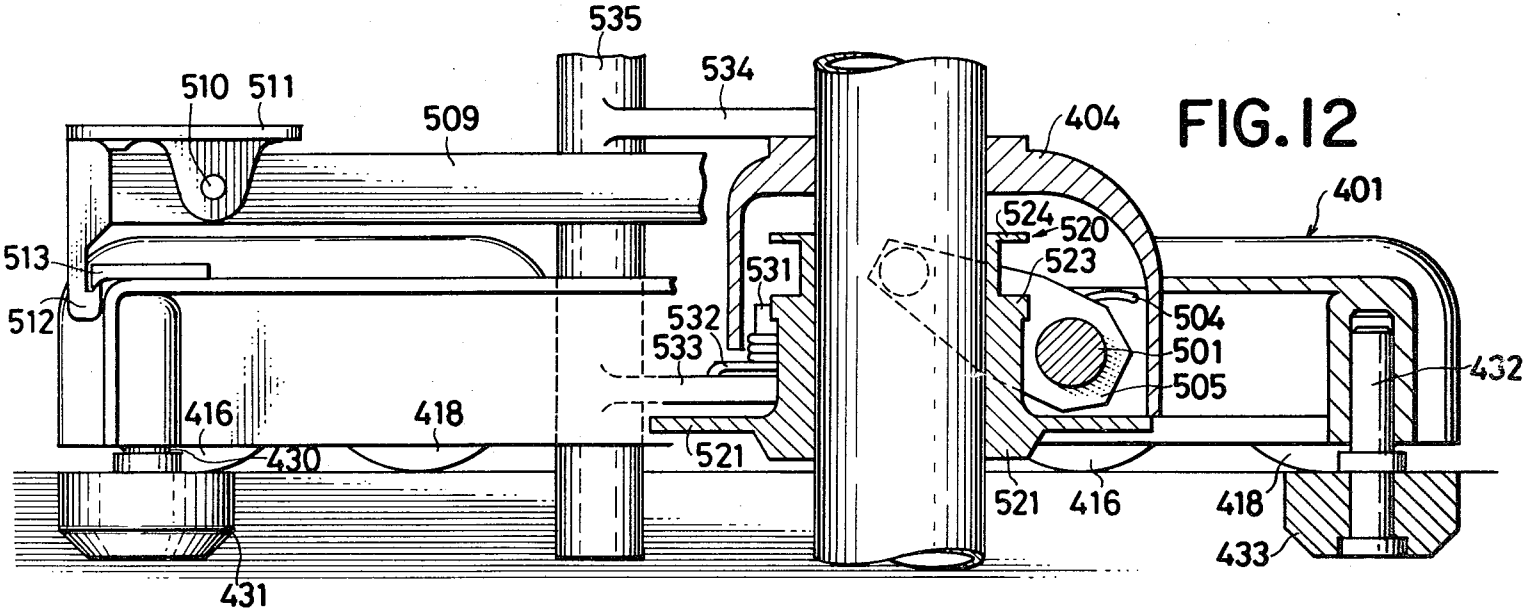
FIG. 12 is a longitudinal sectional view of the travelling mechanism and the direction changing mechanism.
Figure 13:
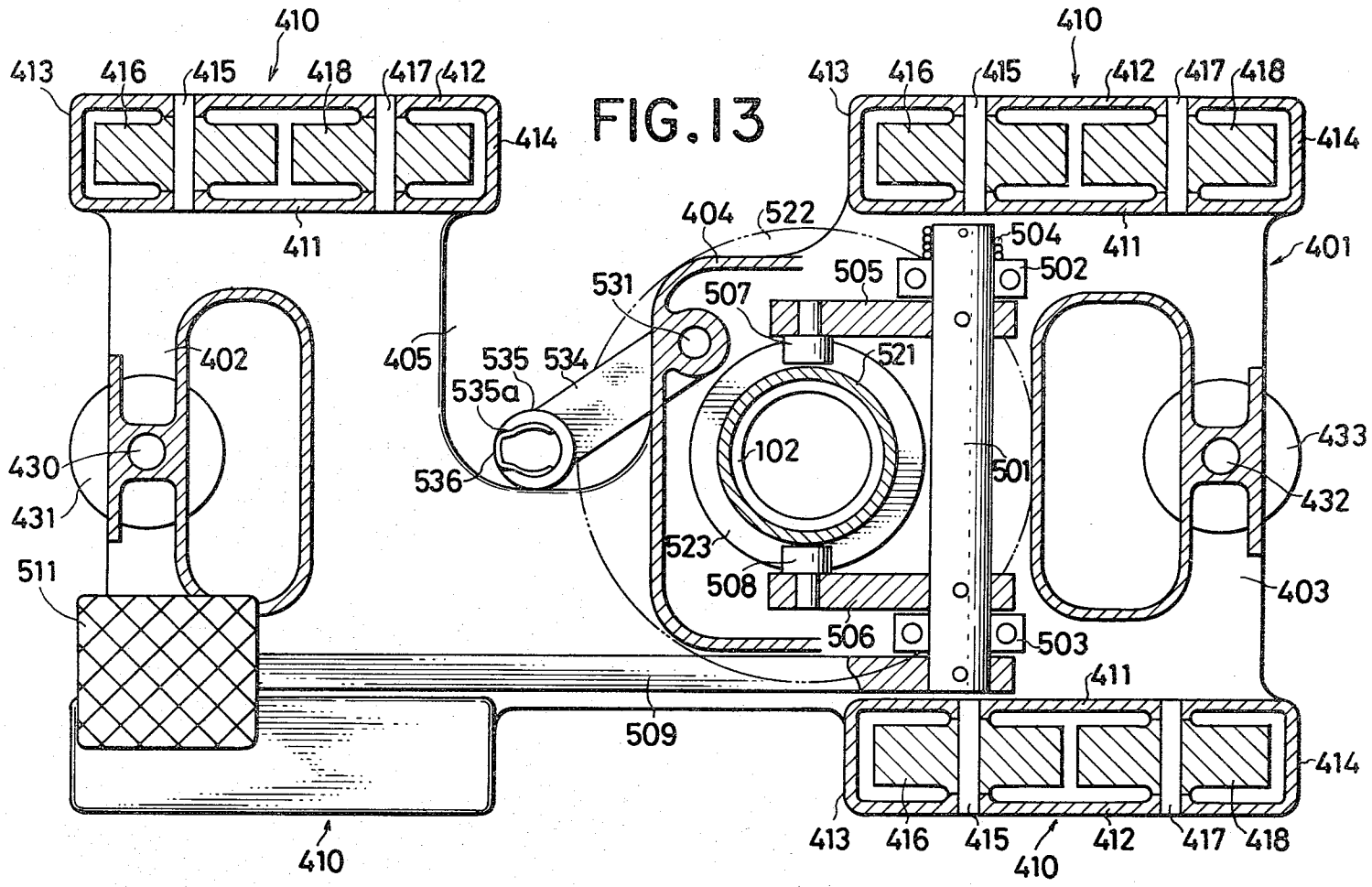
FIG. 13 is a cross-sectional view thereof.
Figure 14:
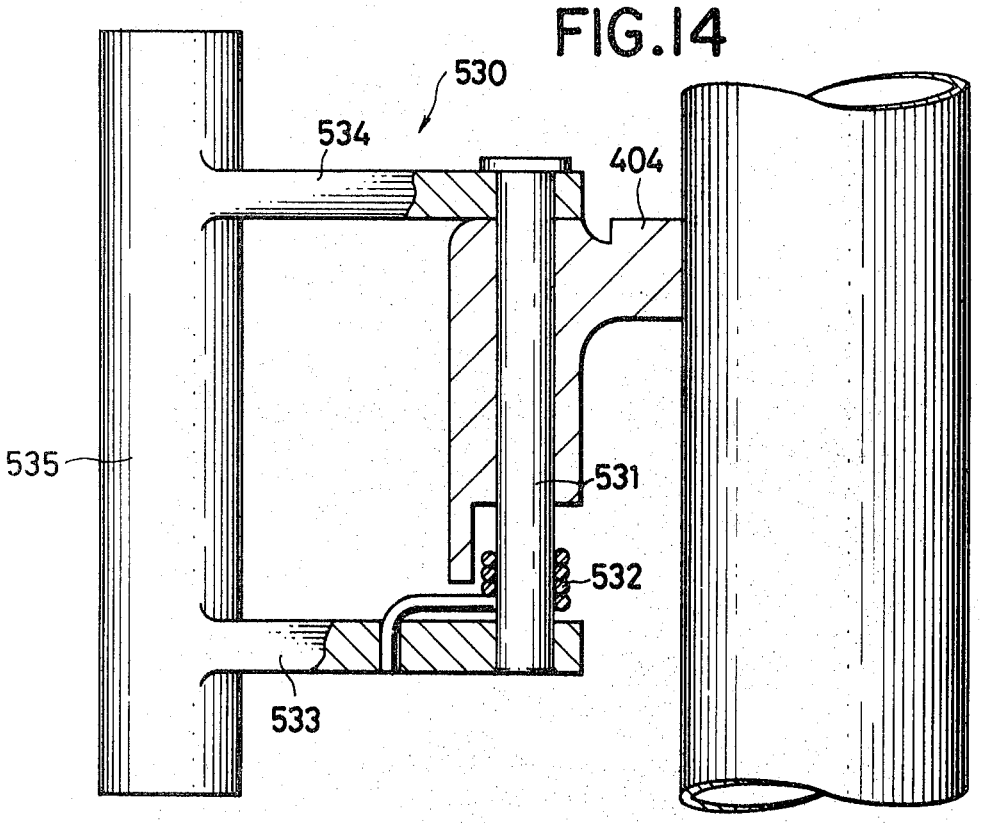
FIG. 14 is a side view of a cylindrical body of the direction changing mechanism where wiring for the illumination light is set.
Figure 15:
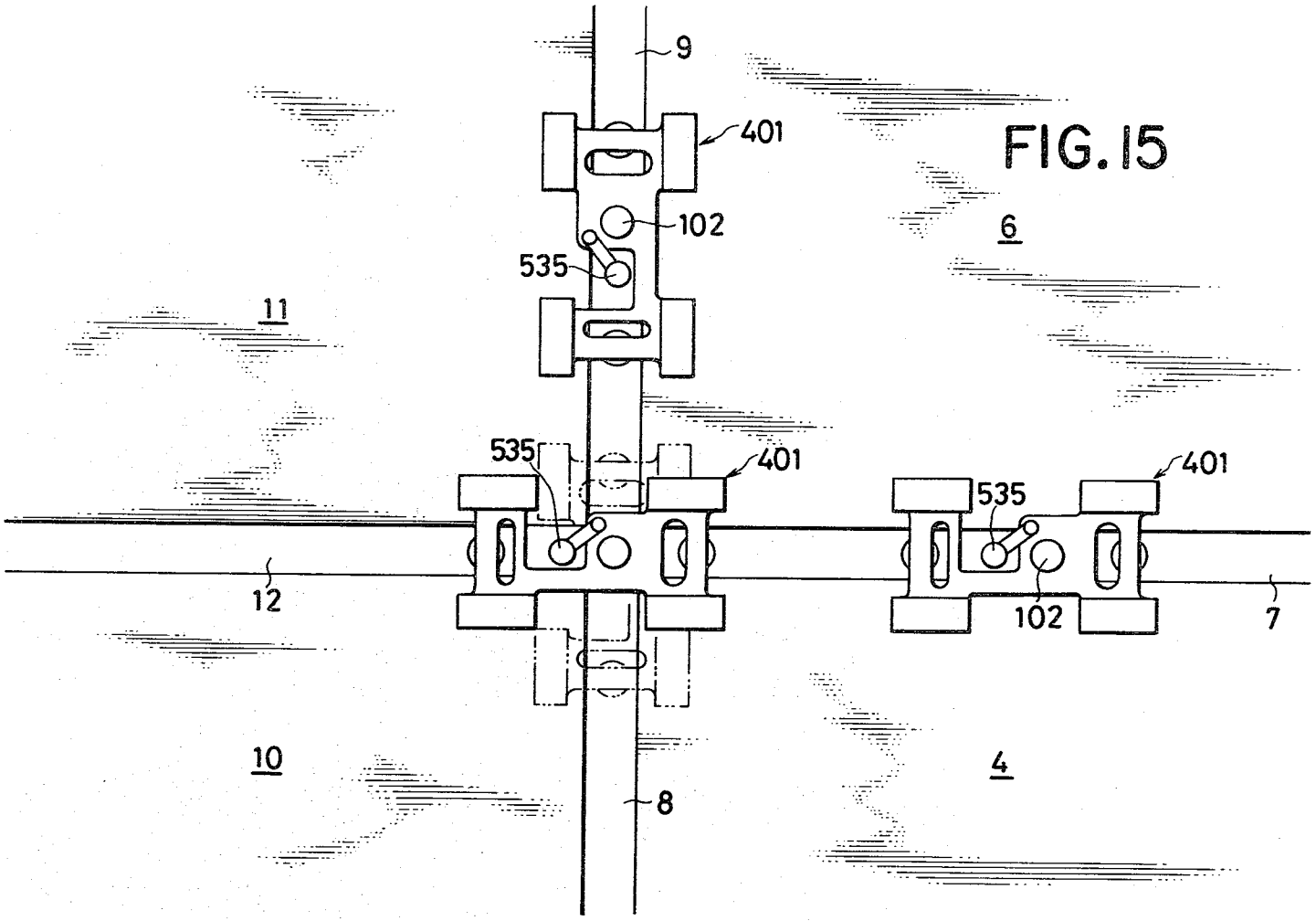
FIG. 15 is a plan view of the suspension system supporting floor for illustrating the operation of the direction changing mechanism.

Now, the travelling mechanism is described with reference to FIGS. 12 and 13. The mechanism comprises a truck 401 having the wheel portions 410 at four corners and a boss portion 404 at its center. Secured in vertical relation to said boss portion 404 is the middle part of the first hanging pipe 102 of the hanging mechanism. A substantially U-shaped space 405 is provided at a side of the boss portion 404 of the truck 401, and also a rib portion 402 is provided at the left end of the truck and another rib portion 403 at the right end. Each of the wheel portions 410 provided at four corners of the truck 401 has two opposing side walls 411, 412 and a front and rear walls 413, 414 provided contiguous to said side walls, and pins 415, 417 are passed between said opposing side walls 411, 412, with wheels 416, 418 being rotatably mounted on said pins 415, 417, respectively. Also, a pin 430 is vertically planted on the underside of the central part of the rib portion 402 at the left end of the truck 401, and a guide wheel 431 is rotatably secured to said pin 430. Likewise, a pin 432 is vertically planted in the right end rib portion 403 and a guide wheel 433 is rotatably secured to said pin 432.

Description is now made on the action of the travelling mechanism. The truck 401 is moved by a spotlight man staying on any of the suspended floor segments 4, 6, 20, 11, 15, 16 in the studio 1. The wheels 416, 418 in the respective wheel portions 410 at the four corners of the truck 401 are placed at the edges of any opposing two of the suspended floor segments 4, 6, 10, 11, 15, 16, while the first hanging pipe 102 of the hanging mechanism 100 secured vertically to the boss portion 404 of the truck 401 is disposed in any of the spaces 7, 8, 9, 12, 13, 14, 17 formed between the opposing floor segments 4, 6, 10, 11, 15, 16, and also the guide wheels 431, 433 provided on the underside of the front and rear portions of the truck 401 are placed in any of the spaces 7, 8, 9, 12, 13, 14, 17 so that the truck 401 is movable along said spaces 7, 8, 9, 12, 13, 14, 17.

The direction changing mechanism of the travelling mechanism is now described with reference to FIGS. 12 to 15. A slider 520 is adapted to the first hanging pipe 102 in the truck 401, said slider 520 comprising a cylindrical body 521 arranged movable vertically around the first hanging pipe 102, said cylindrical body 521 being provided at its upper part with two opposing and vertically spaced-apart flanges 523, 524 and also provided at its lower end with a large-diameter flange 522 designed to serve as a truck push-up plate. Also, a pin 501 is rotatably supported by the fixed plate 502, 503 provided on the underside of the boss portion 404 of the truck 401, and swing levers 505, 506 are secured to said pin 501 in opposed relation at a position outside the slider 520. Rolls 507, 508 are provided inside the corresponding end of said swing levers 505, 506 such that said rolls 507, 508 are held between the flanges 523, 524 of the slider 520. Also, a coil spring 504 is loaded at one end of the pin 501, whereby the pin 501 is given a rotative force to let the swing levers 505, 506 normally stay at their uppermost positions, and accordingly the slider 520 joined to said swing levers 505, 506 is normally set at its uppermost position. A lever 509 is secured to the other end of the pin 501, said lever 509 having provided at its fore end a foot plate 511 swingably pivotted by a pin 510. Provided on the underside of said foot plate 511 is a pawl member 512 arranged engageable with a corresponding plate 513 secured in the truck 401.

In the U-shaped space 405 of the truck 401 is vertically disposed a cylindrical body 535 designed for housing the wiring to the illumination light 126, said cylindrical body 535 having in its side an axial opening **535*a* in which a substantially U-sectioned holding spring 536 is disposed. Extending sidewise from said cylindrical body 535 are an upper lever 534 and a lower lever 533 both of which are secured to a pin 531 planted in the boss portion 404 of the truck 401 so that said cylindrical body 535 is swingable. Also, a coil spring 532 is disposed between said lower lever 533 and the boss portion 404 to have the cylindrical body 535 normally positioned at the central part of the truck 401**.

The direction changing mechanism is operated as follows. Suppose that the truck 401 is now being moved leftward in the space or lane 7. When it is desired to change the direction of the truck 401 toward the lane 9 at the crossing of the lanes 7, 12, 8, 9, first the truck 401 is positioned at the crossing and then the operator steps on the foot plate 511 at the end of the arm 509 to push the arm 509 to its substantially horizontal position, whereby the pawl 512 on the underside of the foot plate 511 is engaged with a plate 513 in the truck 401 to fix the foot plate. When said arm 509 is turned to its substantially horizontal position, the pin 501 to which an end of said arm 509 is secured is accordingly turned, causing corresponding downward turn on the swing levers 505, 506 secured to said pin 501. This also causes downward movement of the rolls 507, 508 carried at the ends of said levers 505, 506, further inducing downward movement of the flanges 523, 524 of the slider 520 in which said rolls 507, 508 are held. As the slider 520 is thus moved downwardly, the truck push-up plate 522 provided at the lower end of said slider 520 presses the opposing corners of the floor segments 4, 6, 10, 11 to raise up the truck 401 so that the guide wheels 431, 433 provided on the underside of the truck 401 separate from the lanes or spaces 7, 12, allowing the truck 401 to freely turn about the slider 520. So the operator turns the truck 401 rightwards in the direction of lanes 8, 9. In this case, the cylindrical body 535 housing the wiring for feeding power to the illumination light 126 abuts against the side wall of the floor segment 10, and as the truck 401 is turned 90°, said cylindrical body 535 is positioned in the lane 12 while remaining stationary against the pressing force of the coil spring 532. Under this condition, the operator again steps on the foot plate 511 to disengage the pawl 512 from the plate 513, allowing the arm 509 to return to its original position, whereby the slider 520 is moved upwardly to lower the truck 401 down to the floor segments. Under this conditon, the truck 401 is now pushed in the direction of the lane 9. The cylindrical body 535 which has been positioned perpendicular to the truck 401 is gradually placed in the U-shaped space 405 of the truck 401, and when the truck 401 clears the crossing, said cylindrical body 535 is properly positioned in said U-shaped space 405 in the truck 401 and moves with the truck 401 in the lane 9. When it is desired to move the truck 401 in the direction of lane 8, the truck 401 is once moved in the direction of lane 9 to let the cylindrical body 535 be properly placed in the U-shaped space 405 in the truck 401 and then the truck 401 is moved in the direction of lane 8.

Figure 16:
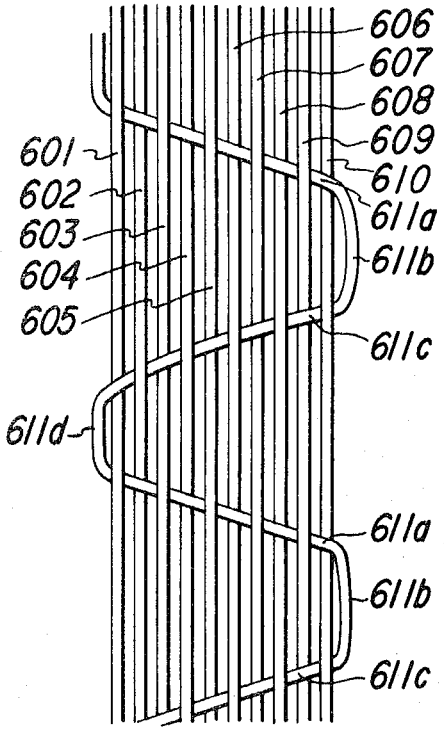
FIG. 16 is a fragmental enlarged plan view of flat wires.
Figure 17:
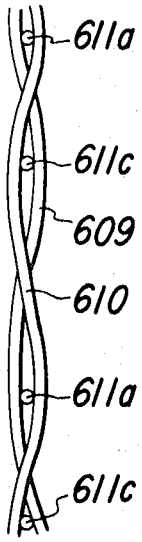
FIG. 17 is a fragmental enlarged side view of flat wires.

Now, the construction of the flat wires 124, 125 used for the hanging mechanism and driving mechanism is described with reference to FIGS. 16 and 17. Each flat wire 124 or 125 consists of 10 pieces of stranded wires 601–610 arranged closely and parallel to each other, and each of said stranded wires 601–610 is formed by twisting 7 pieces of fine wires. Said stranded wires 601–610 are twisted such that adjoining wires differ in the twisting direction, that is, the stranded wires 601, 603, 605, 607, 609 are twisted clockwise while the stranded wires 602, 604, 606, 608, 610 are twisted counterclockwise. Also, a core wire is interwoven crosswise in said parallel-arranged stranded wires 601–610 to form a flat wire 124, 125. Said core wire is formed by clockwise twisting 7 pieces of fine wires, and it is interwoven in said stranded wires 601–610 in such a manner that the rightward slant portion **611*a* of said core wire crosses the stranded wires such that the stranded wires 601, 603, 605, 607, 609 are positioned above said core wire portion 611***a* while the stranded wires 602, 604, 606, 608, 610 are positioned below said core wire portion 611*a*, and just past the rightmost stranded wire 610, said core wire portion 611*a* is bent parallel to the stranded wires to form a bent portion 611*b* from which the leftward slant portion 611*c* further extends to again cross said stranded wires 601–610 such that the stranded wires 602, 604, 606, 608, 610 are positioned above said core wire portion 611*c* while the stranded wires 601, 603, 605, 607, 609 are positioned below said core wire portion 611*c*, and just past the leftmost stranded wire 601, said core wire portion 611*c* is bent parallel to the stranded wires to form a left bent portion 611*d* from which the rightward slant portion 611*a* further extends in the manner said above. In this way, the core wire is interwoven in the parallel-arranged stranded wires 601–610 to form an interwoven flat wire 124, 125.

What is claimed is:

1. A telescopically extendable hanging mechanism for suspending a lighting device, having a driving mechanism provided with wires for controlling extension of said hanging mechanism, wherein the improvement comprises a wire take-up means for winding up or unwinding the wires adapted for telescopically extending out or contracting the hanging mechanism, said wire take-up means being given a rotative force and consisting of three discs of which the outermost disc has a recess at its outer edge; a ratchet wheel provided in said wire take-up means; a sensor lever provided swingably above said wire take-up means and always pressed in the direction of said take-up means, said sensor lever being provided with pawls so arranged that they are engaged with the ratchet wheel when said sensor lever is swung toward said take-up means; a pulley rotatably mounted at an end of said sensor lever and adapted to receive the wires used for telescopically extending out or contracting said hanging mechanism; a limit switch designed to detect any swinging motion of said sensor lever in the direction away from said take-up means to cut off the rotative force; a slider provided slidably on a diametrical portion of the outermost disc of said take-up means, said slider having its one end projected into said take-up means while the other end terminates in a sector portion positioned in the recess of said take-up means; and an unwinding sensor lever provided swingably below said take-up means and always pressed in the direction of said take-up means, said unwinding sensor lever having provided on its underside a roll contacting an outer edge of said take-up means and also provided with a pawl so arranged that it is engaged with the ratchet wheel when said roll is fitted in the recess at the outer edge of said take-up means.

* * * * *